US005936337A

United States Patent [19]

Toujou et al.

[11] Patent Number: 5,936,337

[45] **Date of Patent: *Aug. 10, 1999**

[54] COLOR PICTURE TUBE WITH REDUCED DYNAMIC FOCUS VOLTAGE

[75] Inventors: Tsutomu Toujou, Chousei-gun; Shinichi Kato; Shouji Shirai, both of Mobara, all of Japan

[73] Assignee: Hitachi, Ltd., Tokyo, Japan

[ * ] Notice: This patent is subject to a terminal disclaimer.

[21] Appl. No.: 08/873,751

[22] Filed: Jun. 12, 1997

Related U.S. Application Data

[63] Continuation of application No. 08/336,682, Nov. 7, 1994, Pat. No. 5,677,591.

[30] Foreign Application Priority Data

Nov. 9, 1993 [JP] Japan ..... 5-279265

[51] Int. Cl.[6] ..... H01J 29/51

[52] U.S. Cl. ..... 313/414; 315/15

[58] Field of Search ..... 313/412, 413, 313/414, 425, 428; 315/382, 382.1, 14, 15

[56] References Cited

U.S. PATENT DOCUMENTS

| | | | |
|---|---|---|---|
| 4,178,532 | 12/1979 | Fukuzawa et al. | 313/414 |
| 4,581,560 | 4/1986 | Shirai et al. | 313/414 |
| 4,771,216 | 9/1988 | Blacker et al. | 315/382 |
| 4,772,827 | 9/1988 | Osakabe | 315/382 |
| 4,814,670 | 3/1989 | Suzuki et al. | 315/15 |
| 4,851,741 | 7/1989 | Shirai et al. | 315/382 |
| 5,015,910 | 5/1991 | Takahashi et al. | 313/414 |
| 5,170,101 | 12/1992 | Gorski et al. | 313/412 |
| 5,212,423 | 5/1993 | Noguchi et al. | 313/414 |
| 5,300,855 | 4/1994 | Kweon | 313/414 |
| 5,394,053 | 2/1995 | Yun | 313/414 |
| 5,608,284 | 3/1997 | Tojyou et al. | 313/414 |
| 5,610,481 | 3/1997 | Shirai et al. | 315/382 |
| 5,621,286 | 4/1997 | Toujou et al. | 315/382.1 |

FOREIGN PATENT DOCUMENTS

| | | | |
|---|---|---|---|
| A 0 366 245 | 5/1990 | European Pat. Off. | H01J 29/50 |
| 2663154 | 12/1991 | France | H01J 29/48 |
| A 2 682 809 | 4/1993 | France | H01J 29/50 |
| 2747441 | 4/1978 | Germany | H01J 29/46 |
| 3839389 | 6/1989 | Germany | H01J 29/50 |
| 2-72546 | 3/1990 | Japan | H01J 29/50 |
| 2-18540 | 4/1990 | Japan | H01J 28/50 |
| 05325825 | 12/1993 | Japan | H01J 29/50 |
| A 2 236 613 | 4/1991 | United Kingdom | H01J 29/50 |

OTHER PUBLICATIONS

"Development of Color Picture Tube with Hi–UPF Electron Gun", M. Fukushima et al, Dec. 19, 1977, Electron Device Meeting Material EDD–77–138, and Translation of an Extract.

*Primary Examiner*—Stephen Husar
*Assistant Examiner*—Michael Day
*Attorney, Agent, or Firm*—Antonelli, Terry, Stout & Kraus, LLP

[57] ABSTRACT

In an in-line color picture tube, the length L of the focussing electrode constituting the main lens of the electron gun is at least two times of the diameter D of the main lens and the focussing electrode consists of a first electrode, a second electrode, and a third electrode. The electron gun has a correction electrode for forming a quadrupole lens in at least one of the opposing ends of the first electrode and the second electrode and the opposing ends of the second electrode and the third electrode and a voltage which varies in synchronization with the deflection current is applied to the first electrode and the third electrode, respectively.

19 Claims, 10 Drawing Sheets

COLOR PICTURE TUBE WITH REDUCED DYNAMIC FOCUS VOLTAGE

This application is a Continuation application of U.S. application Ser. No. 08/336,682, filed Nov. 7, 1994, now U.S Pat. No. 5,677,591.

BACKGROUND OF THE INVENTION

The present invention relates to the shape of electrodes constituting the main lens of the electron gun of a color picture tube and to voltage application to each of the electrodes.

FIG. 1 is a plan view of a color picture tube provided with an electron gun having the conventional structure. A phosphor screen 3 on which stripes of phosphors in three colors are alternately coated is supported on the inner wall of a face plate 2 of a glass vacuum envelope 1. Central axes 16, 17, and 18 of cathodes 6, 7, and 8 coincide with the central axes of the apertures of a G1 electrode 9, a G2 electrode 10, a focussing electrode unit or assembly 12 comprised of one or more members and hereafter referred to as a focusing electrode constituting a main lens and a shield cup 14 which correspond to the respective cathodes and are arranged almost in parallel with each other on the common plane. Although the central axis of the center aperture of an accelerating electrode 13 which is another electrode constituting the main lens coincides with the aforementioned central axis 17, central axes 19 and 20 of the side apertures do not coincide with the central axes 16 and 18 which correspond to them respectively and are slightly displaced outside. Three electron beams emanated from each cathode enter the main lens along the central axes 16, 17, and 18, respectively. A focussing voltage of about 5 to 10 kV is applied to the focussing electrode 12 and an accelerating voltage of about 20 to 30 kV is applied to the accelerating electrode 13 so as to provide the same potentials as those of the shield cup 14 and a conductive coating 5 installed inside the glass vacuum envelope. The center apertures of the focussing and accelerating electrodes are coaxial with each other, so that the main lens which is formed at the center is rotationally symmetrical and the center beam is focussed by the main lens and goes straight on the path along the axis. On the other hand, the central axes of the side apertures of both the electrodes are displaced from each other, so that a rotationally asymmetrical main lenses are formed on both sides. As a result, side beams pass through the part dislocated from the central axis of the lens toward the center beam in the diverging lens area formed on the accelerating electrode side in the main lens area and are applied with the converging force toward the central beam as well as focussing action by the main lens. In this way, the three electron beams converge so as to overlap each other at an aperture of a shadow mask 4 as well as focus. An operation for converging three beams in this way is called static convergence (hereinafter abbreviated to STC). Furthermore, each electron beam is subjected to color selection by the shadow mask and only a portion of each beam which excites the phosphor of the intended color corresponding to each beam so as to emit light passes through the aperture of the shadow mask and reaches the phosphor screen. To allow the electron beams to scan on the phosphor screen, a magnetic deflection yoke 15 external to a color picture tube is installed around the neck portion of the vacuum envelope 1.

It is known that by combining an in-line electron gun in which three initial electron beam paths are arranged on a horizontal plane as mentioned above and a so-called self-convergent deflection yoke for forming a special nonuniform magnetic field distribution, if the three electron beams are statically converged at the center of the screen, they can be converged over the entire screen. However, when the self-convergent deflection yoke is used, the deflection aberration is increased due to nonuniformity of the magnetic field distribution and the resolution in the peripheral area of the screen is reduced. FIG. 2 shows beam spots on the screen distorted due to deflection aberration schematically. In the peripheral area of the screen, a high brightness portion c (core) of the electron beam spot which is indicated by diagonal lines extends horizontally and a low brightness portion h (halo) extends vertically.

A means for solving this problem is indicated in Japanese Patent Application Laid-Open No. 2-72546. FIG. 3 shows an example of the structure of a conventional electron gun. The focussing electrode 112 is divided into two parts in the direction from the cathode to the phosphor screen, such as a first member 127 and a second member 128. In the end face of the second member 128 which is opposite to the first member 127, flat electrodes 124 are installed above and under the electron beam passing aperture and extended into the first member via the single opening installed in the end face of the first member which is opposite to the second member. Inside the first member 127, an electrode 125 with an electron beam passing aperture provided is arranged at a fixed interval from the flat electrodes 124. A voltage which varies dynamically in synchronization with the deflection current supplied to the deflection yoke, that is, a dynamic focus voltage Vd is given to the second member 128 and the flat electrodes 124 together with a focussing voltage Vf superposed. When the amount of deflection is large, the potential difference between the first and second members is increased, so that the quadrupole lens effect of a rotationally asymmetrical electron lens formed by the flat electrodes is increased and a great astigmatic aberration is generated in the electron beam passing between the aforementioned flat electrodes. When the potential of the second member 128 is higher than that of the first member 127, an astigmatic aberration generated in the electron beam has an effect for extending the core vertically and the halo horizontally. Therefore, the astigmatic aberration accompanying the electron beam deflection shown in FIG. 2 can be offset and the resolution in the peripheral area of the screen can be improved. On the other hand, when the electron beam is not deflected, by eliminating the potential difference between the first and second members, no rotationally asymmetrical electron lens is formed and astigmatic aberration can be eliminated at the center of the screen. Therefore, the resolution will not be degraded.

In the color picture tube, the distance from the main lens to the peripheral area of the screen is longer than the distance from the main lens to the center of the screen. Therefore, the voltage condition for focussing the electron beam is different between the center and peripheral area of the screen. Under the voltage condition for focussing the electron beam at the center of the screen, the electron beam in the peripheral area is not focussed and the resolution becomes worse. This is referred to as curvature-of-field aberration. However, in a conventional example shown in FIG. 3, when the electron beam is deflected to the peripheral area of the screen, the potential of the second member 128 is increased, so that the voltage difference from the accelerating voltage of the accelerating electrode 13 is reduced and the lens strength of the main lens is decreased. Therefore, the focus point of an electron beam is moved toward the phosphor screen and the electron beam can be focussed on the phosphor screen even in the peripheral area of the screen. As a result, the resolution in the peripheral area can be prevented from degradation. Namely, a dynamic correction of astigmatic aberration as well as a dynamic correction of curvature-of-field aberration can be realized.

However, in a cathode ray tube of wide angle deflection, the deflection aberration is increased, so that a dynamic focus voltage which is a comparatively high voltage of more than 1 kV is necessary so as to correct it.

According to the aforementioned prior art, a cathode ray tube of wide angle deflection requires a dynamic focus voltage which is a comparatively high voltage and for that purpose, the cost of a dynamic focus voltage generating circuit is increased inevitably due to its high voltage or the deflection aberration is not corrected fully due to an insufficient amplitude of the dynamic focus voltage and the resolution in the peripheral area is degraded.

SUMMARY OF THE INVENTION

An object of the present invention is to provide a color picture tube having an electron gun which can lower the dynamic focus voltage below the conventional one with the focus characteristics kept satisfactory.

To accomplish the above object, the present invention is a color picture tube provided with an electron gun having a first electrode means for generating a plurality of electron beams and directing these electron beams to a phosphor screen along initial paths which are parallel to each other on one horizontal plane and a second electrode means constituting a main lens for focussing each aforementioned electron beam to the phosphor screen, wherein the electron gun is structured so that the main lens comprises a first accelerating electrode, a focussing electrode, and a second accelerating electrode toward the phosphor screen in the order named, and the length of the focussing electrode is at least two times the diameter of the main lens, and the electron gun gives a high potential to the first accelerating electrode and the second accelerating electrode and a direct medium potential to the focussing electrode, constructs the focussing electrode of at least three members such as a first member, a second member, and a third member toward the phosphor screen, has a correction electrode for forming a rotationally asymmetrical electron lens in at least one of the spaces between the third member and the second member and between the first member and the second member, and gives potential which varies in synchronization with the deflection current to be supplied to the deflection yoke which is installed around a neck portion of a vacuum envelope so as to scan each electron beam mentioned above and independently of the potential given to the second member to the first member and the third member, respectively, and the lens strengths which are formed in the rotationally asymmetrical electron lens and formed between the first accelerating electrode and the first member and formed between the second accelerating electrode and the third member vary in accordance with the deflection angle of the electron beam.

Furthermore, according to the present invention, to form the aforementioned rotationally asymmetrical electron lens, a pair of flat electrodes which are electrically connected to the third member or the first member are arranged above and under the electron beam passing aperture which is made in the face of at least one of the third member and first member which is opposite to the second member, and the flat electrodes are extended into the second member via the single opening which is made in the opposite end face of the second member on the side where the flat electrodes are arranged, and an electrode plate which is electrically connected to the second member and has an aperture for each electron beam is arranged in the second member at a fixed interval from the flat electrodes.

Furthermore, according to the present invention, to form the aforementioned rotationally asymmetrical electron lens, an individual horizontally elongated electron beam passing aperture is made in the face of at least one of the third member and first member which is opposite to the second member for each electron beam and an individual vertically elongated electron beam passing aperture is made in the face of the second member which is opposite to at least one of the third member and first member for each electron beam so as to form a counterpart to each horizontally elongated electron beam passing aperture mentioned above.

In the aforementioned electrode structure of the present invention, the first member and third member increase in potential when the electron beam is deflected, so that the voltage difference from the accelerating voltage of the neighboring accelerating electrode is reduced and the lens strengths at the two locations are lowered. As a result, compared with an electron gun of the prior art, the focus point of an electron beam moves efficiently toward the phosphor screen and the electron beam can be focussed onto the phosphor screen even in the peripheral area of the screen. Namely, the field-of-curvature aberration can be corrected at a lower dynamic focus voltage than that of the conventional electron gun. In this case, the length of the focussing electrode is at least 2 times the diameter of the main lens, so that the degradation of resolution due to an increase in the beam spot diameter by the spherical aberration can be suppressed.

When the electron beam is deflected, the potential difference between the members is increased. Therefore, by the action of quadrupole lens of the rotationally asymmetrical electron lens which is installed between the first member and the second member or between the second member and the third member, the cross-sectional shape of the electron beam becomes vertically elongated and the astigmatic aberration can be offset. In this case, by forming quadrupole lenses both between the first and the second members and between the second and the third members or by installing the single quadrupole lens between the first and second members or between the second and third members and increasing the strength of the single quadrupole lens, the astigmatic aberration can be corrected at a lower dynamic focus voltage than the conventional one.

By the above action, an increase in the dynamic focus voltage can be avoided. By doing this, an increase in the cost of the dynamic focus voltage generating circuit can be suppressed. Or, degradation of the resolution in the peripheral area of the screen due to an insufficient magnitude of the dynamic focus voltage can be suppressed.

DETAILED DESCRIPTION OF THE PREFERRED EMBODIMENTS

Figure 4:
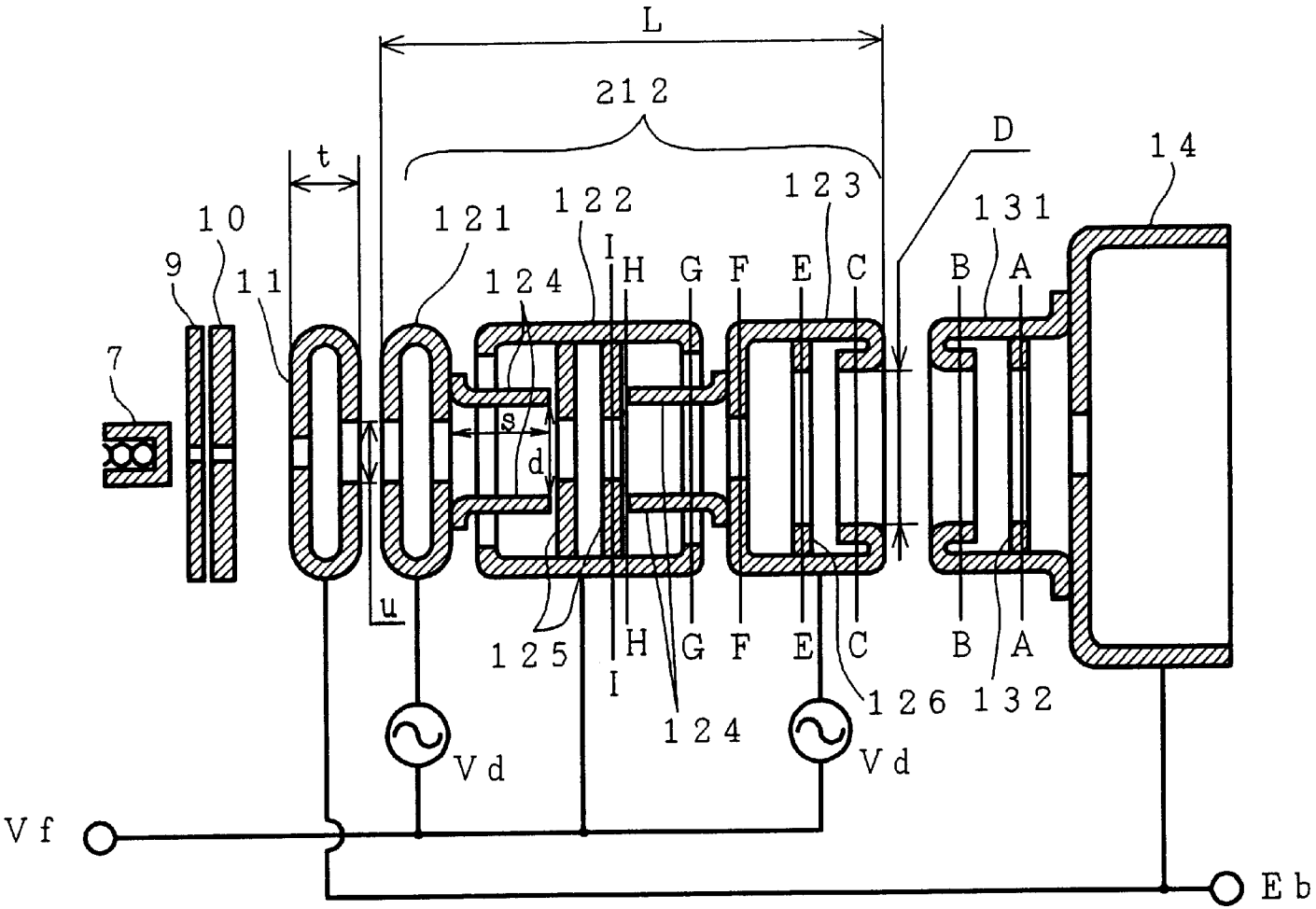
FIG. 4 is an axial section view of the electron gun of the first embodiment of the present invention.
Figure 5:
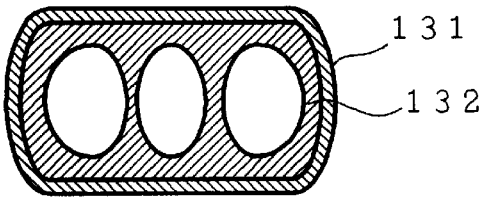
FIG. 5(*a*) to FIG. 5(*h*) are section views of lines A—A, B—B, C—C, E—E, F—F, G—G, H—H, and I—I of the essential sections of the electrode shown in FIG. 4, respectively.
Figure 5:
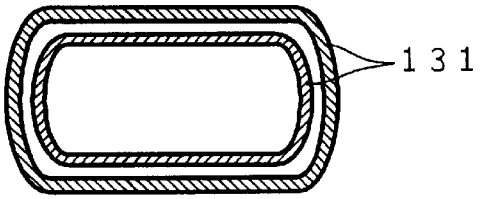
Figure 5:
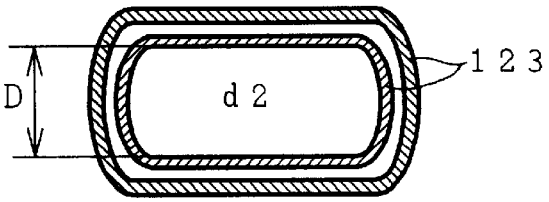
Figure 5:
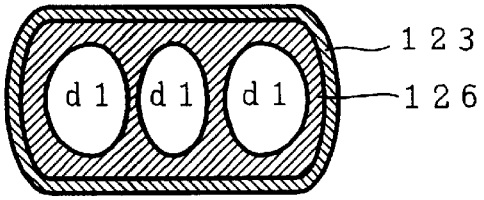
Figure 5:
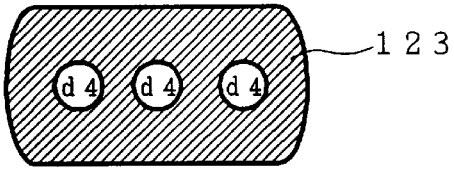
Figure 5:
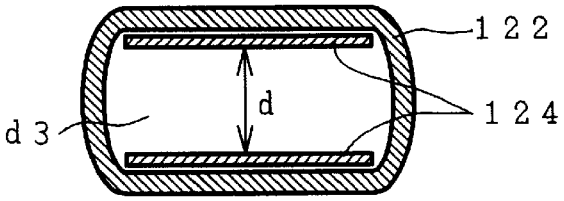
Figure 5:
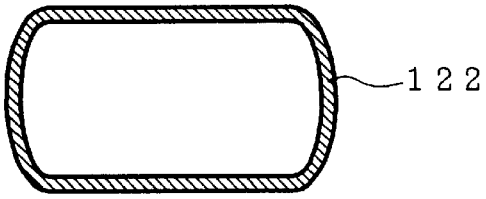
Figure 5:
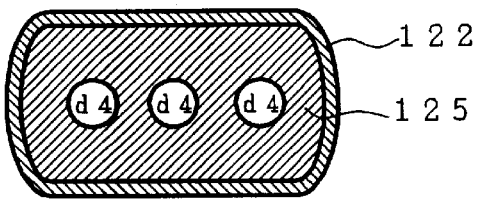

FIG. 4 shows an embodiment of the present invention. FIG. 5(*a*) to FIG. 5(*h*) are section views of lines A—A, B—B, C—C, E—E, F—F, G—G, H—H, and I—I of the essential sections of the electrode shown in FIG. 4, respectively. The main lens consists of a first accelerating electrode 11, a focussing electrode 212, and a second accelerating electrode 131. The length of the first accelerating electrode 11 is taken as t and the diameter of the electron beam passing aperture of the first accelerating electrode 11 which is formed on the side of the focussing electrode 212 is taken as u. The focussing electrode 212 is divided into three parts such as a first member 121, a second member 122, and a third member 123, and a single opening d3 is formed in a respective face of the second member 122 which is opposite to the adjacent electrodes 121 and 123, and electrode plates 125 having three circular electron beam passing apertures d4 are arranged inside the second member 122. Three circular electron beam passing apertures are formed in the faces of the first member 121 and the third member 123 which are opposite to the second member 122 and flat electrodes 124 which are extended toward the second member 122 are connected above and under the passing apertures. The aforementioned electron beam passing apertures d4 of the electrode plates 125 arranged in the second member 122, the first member 121, and the third member 123 are coaxial and of the length L of the focussing electrode 212 as shown in FIG. 4 is measured from an end thereof facing the first accelerating electrode 11 to an end thereof facing the second accelerating electrode 131 the same shape.

A fixed focussing voltage Vf is applied to the second member 122 and a dynamic focus voltage Vd superposed on Vf is applied to the first member 121 and the third member 123. When the electron beam is deflected, Vd increases as the amount of deflection increases. As Vd increases, the strength of quadrupole lens of the rotationally asymmetrical electron lenses formed in the opposite portions of the first and second members and of the second and third members increases and the astigmatic aberration caused by electron beam deflection can be corrected. Simultaneously, the voltage difference between an accelerating voltage Eb applied to the accelerating electrode 11 and the applied voltage to the first member 121 and the voltage difference between an accelerating voltage Eb applied to the accelerating electrode 131 and the applied voltage to the third member 123 are reduced, and the lens strength is weakened, and the distance between the lens and the electron beam focussing point is lengthened, and the electron beam can be focussed on the phosphor screen even in the peripheral area of the screen.

Namely, by applying a comparatively low dynamic focus voltage, dynamic correction of the astigmatic aberration and dynamic correction of the curvature-of-field aberration are executed at the same time and the resolution in the peripheral area of the screen can be improved.

However, in the case of a unipotential type electron gun, when the aforementioned focussing electrode length L is short, the spherical aberration will be increased.

In Institute for Electrical Engineers, Electron Device Meeting Material EDD-77-138, the relationship between the focussing electrode length and spherical aberration is discussed for the fixed diameter of the main lens.

Figure 9:
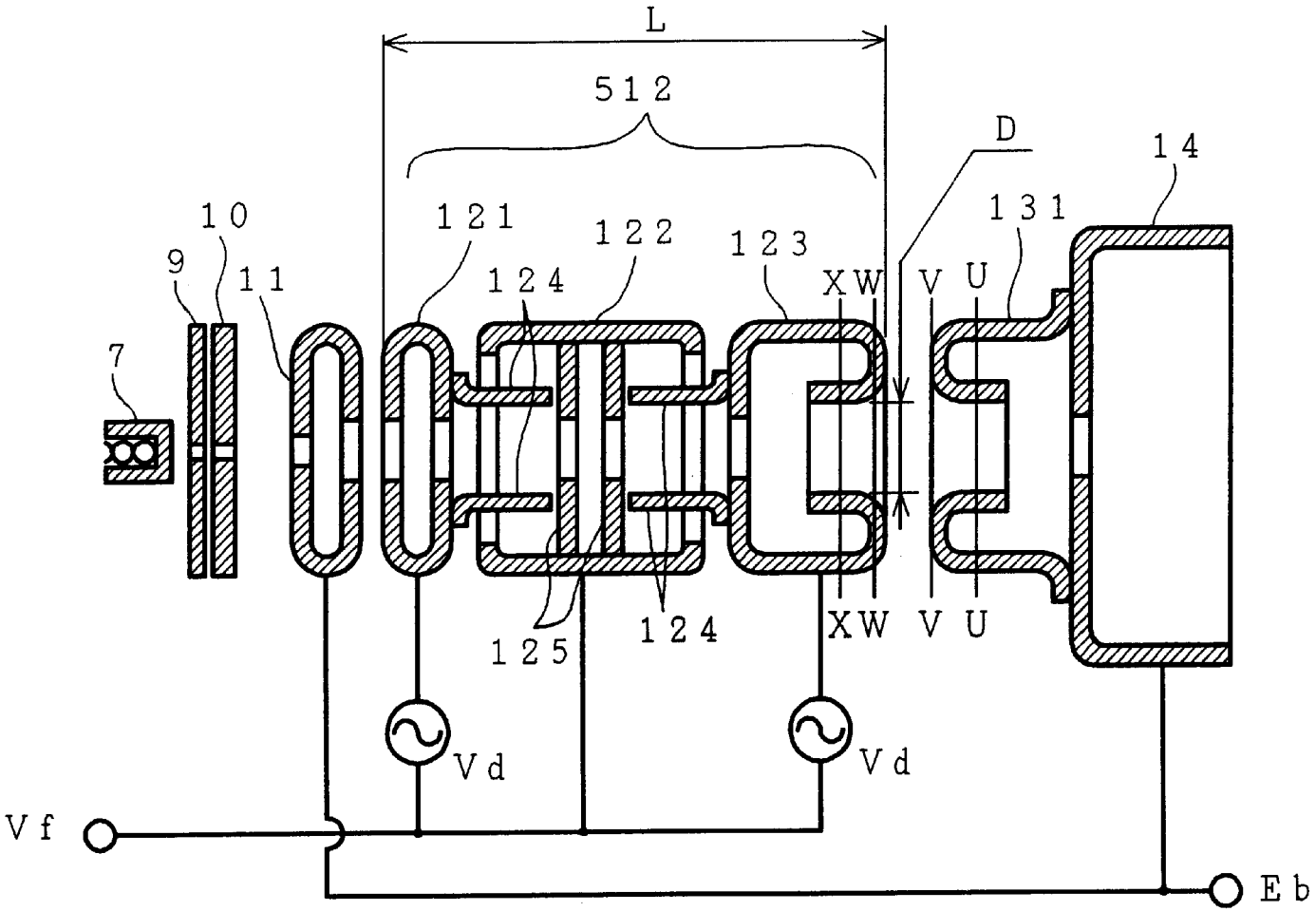
FIG. 9 is an axial section view of the electron gun of the fourth embodiment of the present invention.
Figure 10:
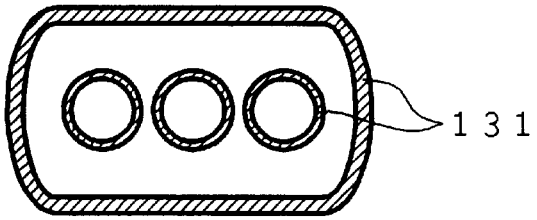
FIG. 10(*a*) to FIG. 10(*d*) are section views of lines U—U, V—V, W—W, and X—X of the essential sections of the electrode constituting the main lens shown in FIG. 9, respectively.
Figure 10:
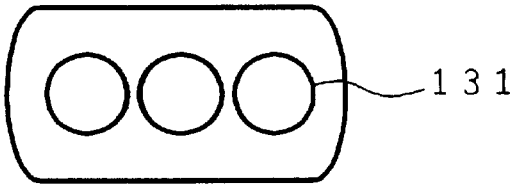
Figure 10:
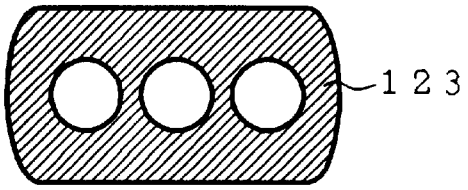
Figure 10:
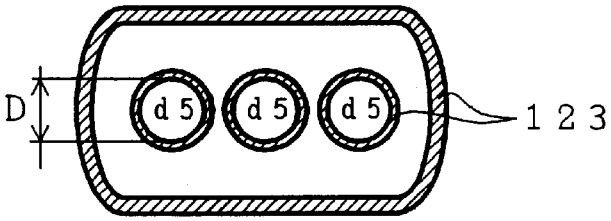

Next, the diameter of the main lens is defined as follows: In the structure of a main lens as indicated in Japanese Patent Publication No. 2-18540, that is, in a main lens having the structure is opposed to an electrode plate 126 having in which a single horizontally elongated opening d2 as shown in FIG. 5(*c*) and an independent opening d1 for each electron beam as shown in FIG. 5(*d*), the diameter of the main lens is the short diameter D of the single opening of the focussing electrode. The reason is that in a non-circular main lens as shown in FIG. 5(*c*), the diameter of the main lens in the vertical direction depends on the short diameter D of the single opening d2, that is, the vertical opening diameter. The diameter of the main lens in the horizontal direction can be made effectively equal to the vertical opening diameter by the action of the electrode plate 126 having the non-circular aperture dl arranged inside the electrode 123 and the main lens diameter in each direction can be balanced. In a main lens having the structure in which cylinders as shown in FIG. 9 and FIG. 10(*a*) to FIG. 10(*d*) are opposite to each other, the main lens diameter is the diameter D of the opening d5 of the focussing electrode. FIG. 10(*a*) to FIG. 10(*d*) are section views of lines U—U, V—V, W—W, and X—X shown in FIG. 9, respectively.

In the aforementioned reference "Institute for Electrical Engineers, Electron Device Meeting Material EDD-77-138", the analysis on the electron beam passing aperture in the main lens electrode, that is, the main lens diameter, of 5.5 mm shows that when the focussing electrode length exceeds 11 mm, the spherical aberration saturates and approaches almost a fixed value. The spherical aberration when the focussing electrode length is 11 mm is only 10% larger than the minimum value. On the other hand, when the focussing electrode length is shorter than 11 mm, the spherical aberration increases rapidly.

The above data is obtained by analyzing the main lens of 5.5 mm in diameter. Therefore, it indicates the focussing electrode length must be at least two times the main lens diameter, that is, at least 11 mm in this case, and if not the beam spot diameter is increased because the spherical aberration increases, and the resolution is degraded.

When the focussing electrode length is less than two times the main lens diameter, the following problem will be imposed. Namely, when the focussing electrode length becomes less than two times the main lens diameter, the interference of two lenses formed between the first and second accelerating electrodes and the focussing electrode is increased and the two lenses will not be independent of each other. Therefore, improvement of the correction sensitivity of curvature-of-field aberration obtained by weakening the lens strengths at two locations is lost.

In the embodiment shown in FIG. 4, also the problem with beam convergence can be solved. Since the potential difference between the accelerating voltage Eb and the voltage of the third member in the main lens section is reduced as the dynamic focus voltage Vd increases, the electric field intensity lowers therebetween. Therefore, the rotationally asymmetrical component of the electric field having a function of deflecting the side beams toward the center beam for beam convergence is lowered at the same time and the amount of deflection of the side beams is reduced. However, in the embodiment shown in FIG. 4, an action for increasing the amount of deflection of the side beams is generated in the quadrupole lens as the dynamic focus voltage vd increases, so that it is possible to compensate for the aforementioned reduction and to provide convergence always even if Vd varies and by changing the electrode length s of the flat electrodes 124 and the spacing d between the flat electrodes 124, the convergence compensation amount can be adjusted comparatively easily.

An experimental tube was fabricated for the embodiment shown in FIG. 4 in the following dimensions.

| | |
|---|---|
| Length of the first member of focussing electrode: | 8.0 mm |
| Length of the second member of focussing electrode: | 16.0 mm |
| Length of the third member of focussing electrode: | 10.0 mm |
| Focussing electrode length L: | 38.0 mm |
| Diameter of main lens D: | 10.4 mm |
| Electrode length s of flat electrodes 124: | 3.0 mm |
| Spacing d between flat electrodes 124: | 5.4 mm |
| Electrode length t of first accelerating electrode: | 2.1 mm |
| Diameter of electron beam passing aperture of first accelerating electrode formed on the focussing electrode side: | 4.0 mm |

Figure 1:
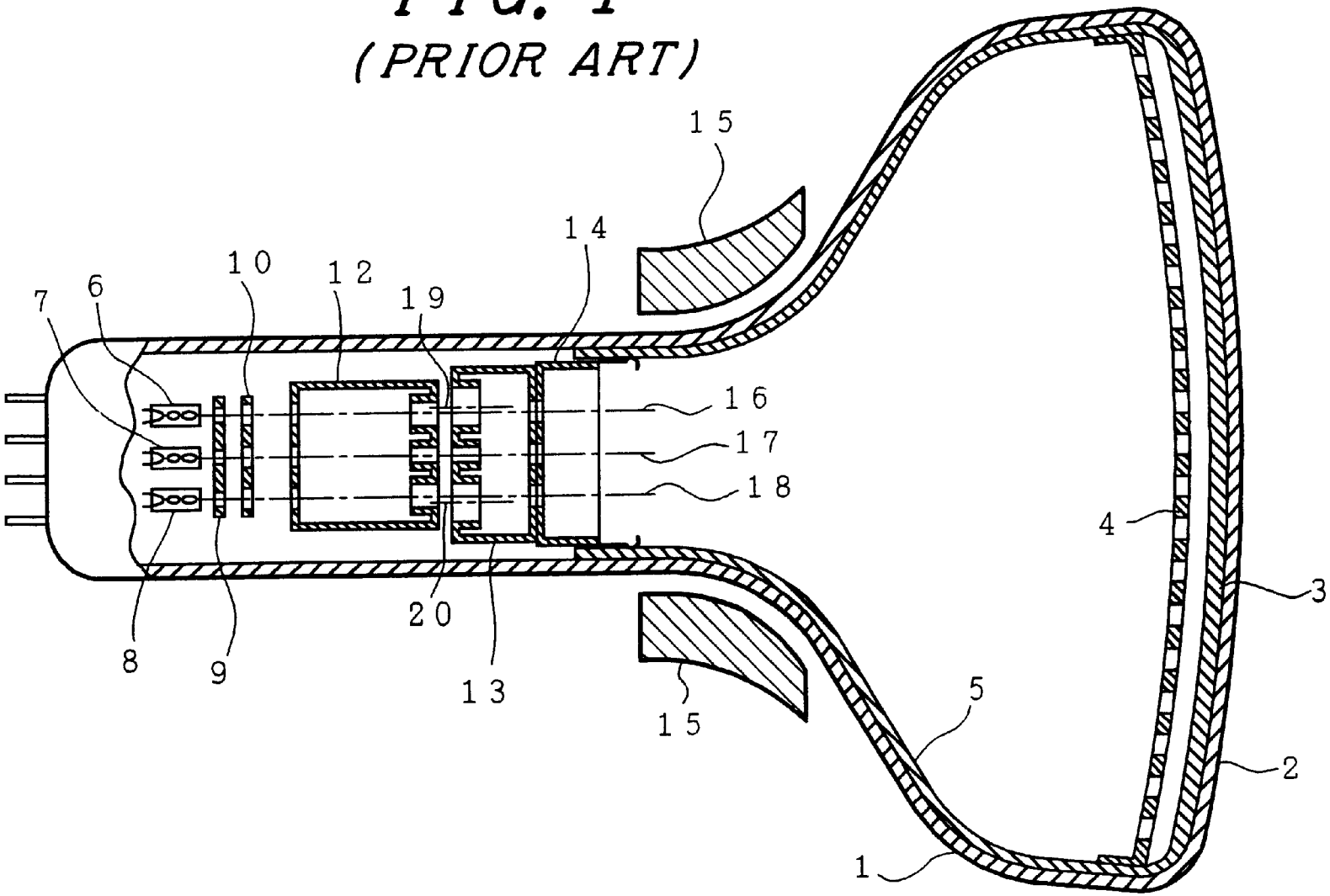
FIG. 1 (PRIOR ART)
FIG. 1 is a schematic plan view in axial section of a conventional in-line type color picture tube.
Figure 2:
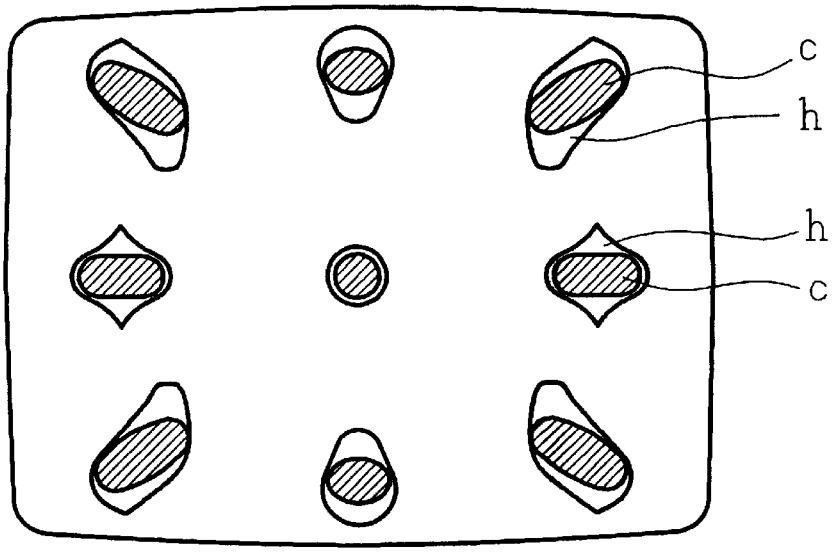
FIG. 2 (PRIOR ART)
FIG. 2 is a schematic view of the electron beam spot shape at each point on the screen of a color picture tube using a conventional electron gun.
Figure 3:
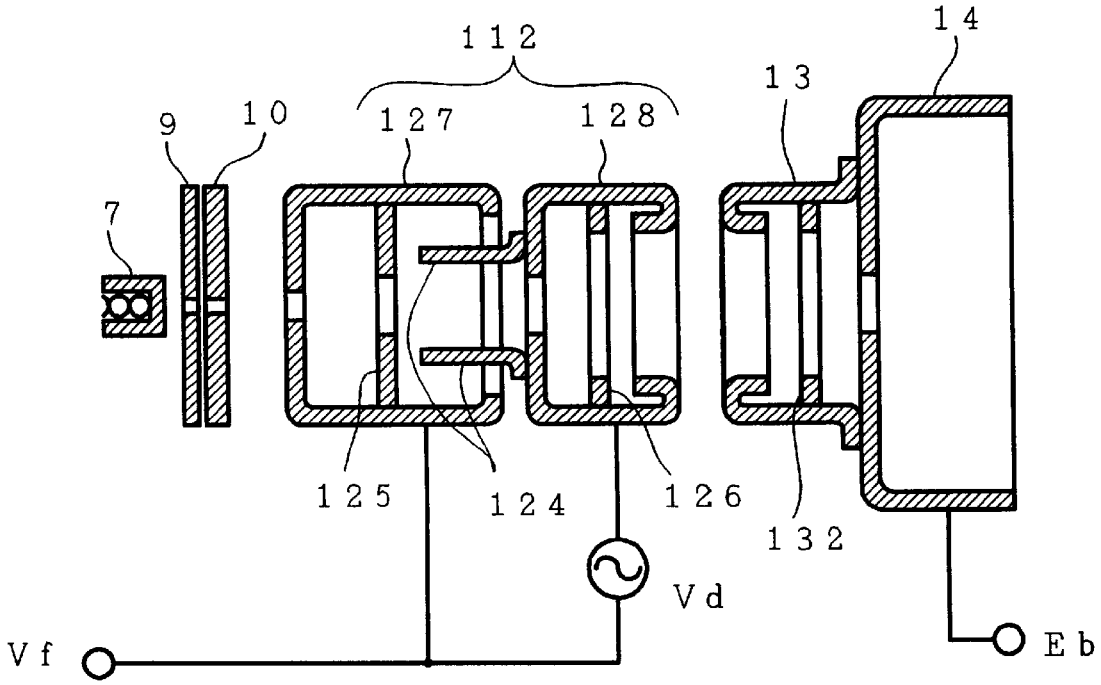
FIG. 3 (PRIOR ART)
FIG. 3 is an axial section view of a conventional electron gun.

As a result of evaluation of the above prototype under the condition that the accelerating voltage Eb was set to 30 kV and the focussing voltage Vf was set to 8.4 kV, the dynamic focus voltage Vd turned out to be 1.0 kV, accordingly it would be reduced by 20% from that of the electron gun in the conventional example shown in FIG. 3. The beam spot diameter at the center of the screen for the cathode current of Ik=4 mA could be reduced by 15% from that of the electron gun in the conventional example shown in FIG. 3. As a result, it was confirmed that the astigmatic aberration and curvature-of-field aberration can be corrected at the same time at a lower dynamic focus voltage than that of the electron gun of the conventional example and the focus characteristics can be improved.

In the electron gun of the present invention, by forming a lens having a function of curvature-of-field correction, that is, a curvature-of-field correction lens between the first accelerating electrode 11 and the first member 121 of the focussing electrode mentioned above in addition to the final stage lens formed between the second accelerating electrode 131 and the third member 123 of the focussing electrode mentioned above, the correction sensitivity of curvature-of-field correction as the entire electron gun is improved.

The correction sensitivity of curvature-of-field correction of the electron gun of the present invention is affected by the distance between the aforementioned lens formed between the first accelerating electrode 11 and the first member 121 of the focussing electrode and the aforementioned final stage lens and the correction sensitivity is improved more as the distance between the two lenses becomes shorter.

The reason is that the amount of the focussing action of the lens formed between the first accelerating electrode 11 and the first member 121 of the focussing electrode on the electron beam is increased.

However, there is a limit to shortening of the distance between the two lenses. As mentioned above, when the electrode length L of the focusing electrode which is one of the electrodes for forming the two lenses becomes less than two times the diameter D of the main lens, two lenses formed between the first and second accelerating electrodes 11 and 131 and the focussing electrode 212 interfere with each other and the correction sensitivity of curvature-of-field correction is lowered.

By increasing the electrode length L of the focusing electrode 212 to at least two times the diameter D of the main lens and extending the electrode length t of the first accelerating electrode 11, the sensitivity of curvature-of-field correction can be improved.

Figure 11:
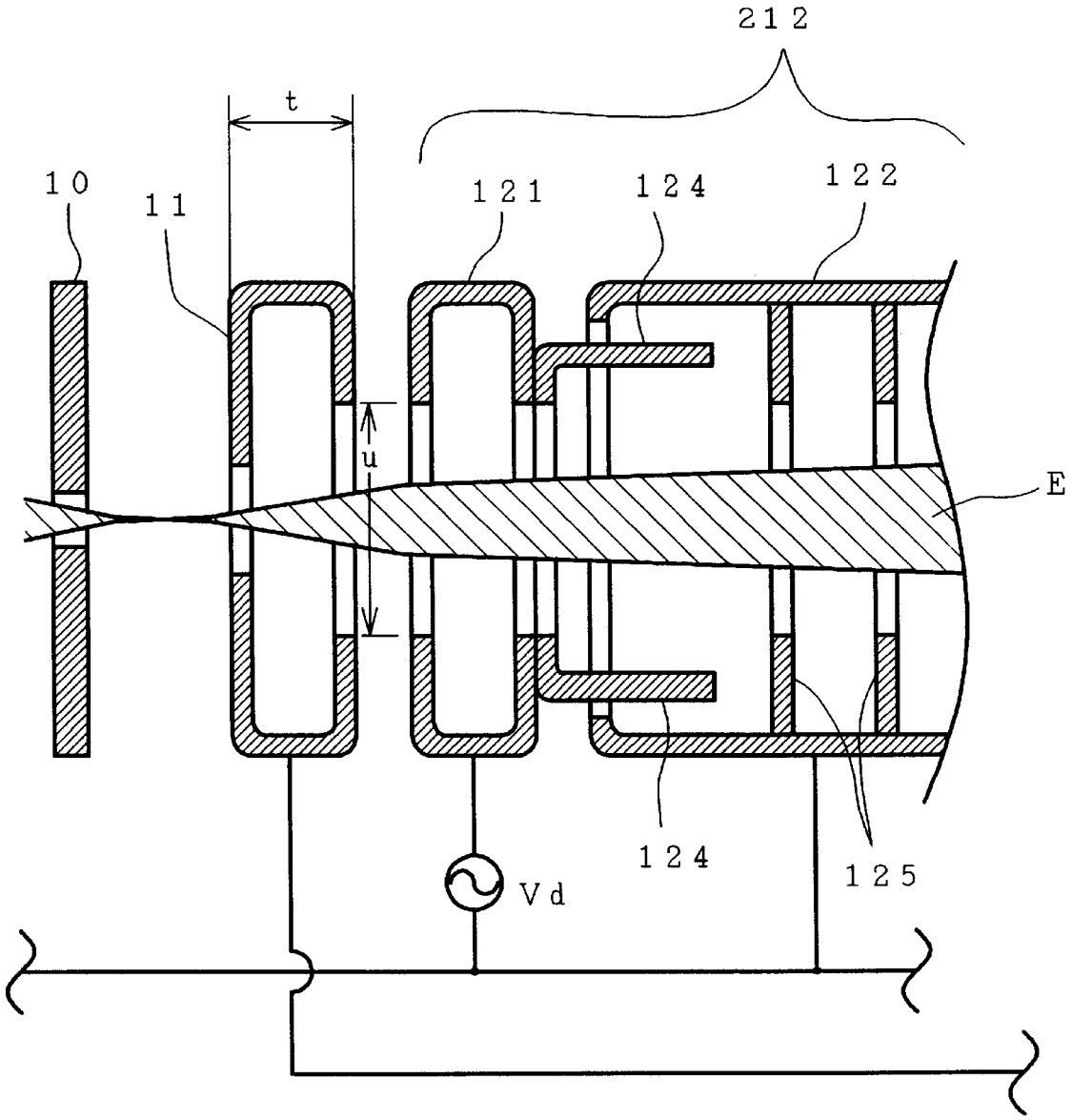
FIG. 11 is an axial section view schematically showing the electron trajectories which pass the electron beam passing aperture of the essential electrode shown in FIG. 4 in the first embodiment of the present invention.

The reason is that, as shown in FIG. 11, the diameter of an electron beam E passing the lens formed between the first accelerating electrode 11 and the first member 121 of the focussing electrode is increased by extending the electrode length t of the first accelerating electrode 11, the resultant ratio of the electron beam diameter to the lens diameter is increased, and the focussing action of the lens on the electron beam is strengthened.

However, there is a limit also to extension of the length t of the first accelerating electrode 11. If the ratio of the electron beam diameter to the lens diameter is excessively increased, the beam spot diameter increases due to an increase of the spherical aberration of the lens and the resolution is degraded.

Experimental tubes were fabricated by varying the length t of the first accelerating electrode 11 with the diameter u of the electron beam passing aperture in the first accelerating electrode 11 on the side of the focussing electrode 212 being 4 mm. When the length t of the first accelerating electrode 11 was two times the diameter u of the electron beam passing aperture, the beam spot diameter increases by about 10%. Therefore, it is desirable to keep the electrode length t of the first accelerating electrode 11 at about two times or less the diameter u of the electron beam passing aperture.

Furthermore, it is necessary that the length t of the first accelerating electrode 11 is at least 10% of the diameter u of the electron beam passing aperture on the focussing electrode side. The reason is that when the length t of the first accelerating electrode 11 is less than 10% of the diameter u of its electron beam passing aperture on the focussing electrode side, the electron beam path becomes steep, and the electrons impinge upon an electrode (the focussing electrode in this embodiment) before it reaches the second accelerating electrode, and the brightness of the phosphor screen decreases (so-called hunting phenomenon). When the first accelerating electrode in the UPF (unipotential focus) type lens is a very thin plate (less than 10% as mentioned above), if a high voltage is applied to it, there increases possibility of the electrode itself being deformed and the lens is distorted by the deformation.

Figure 6:
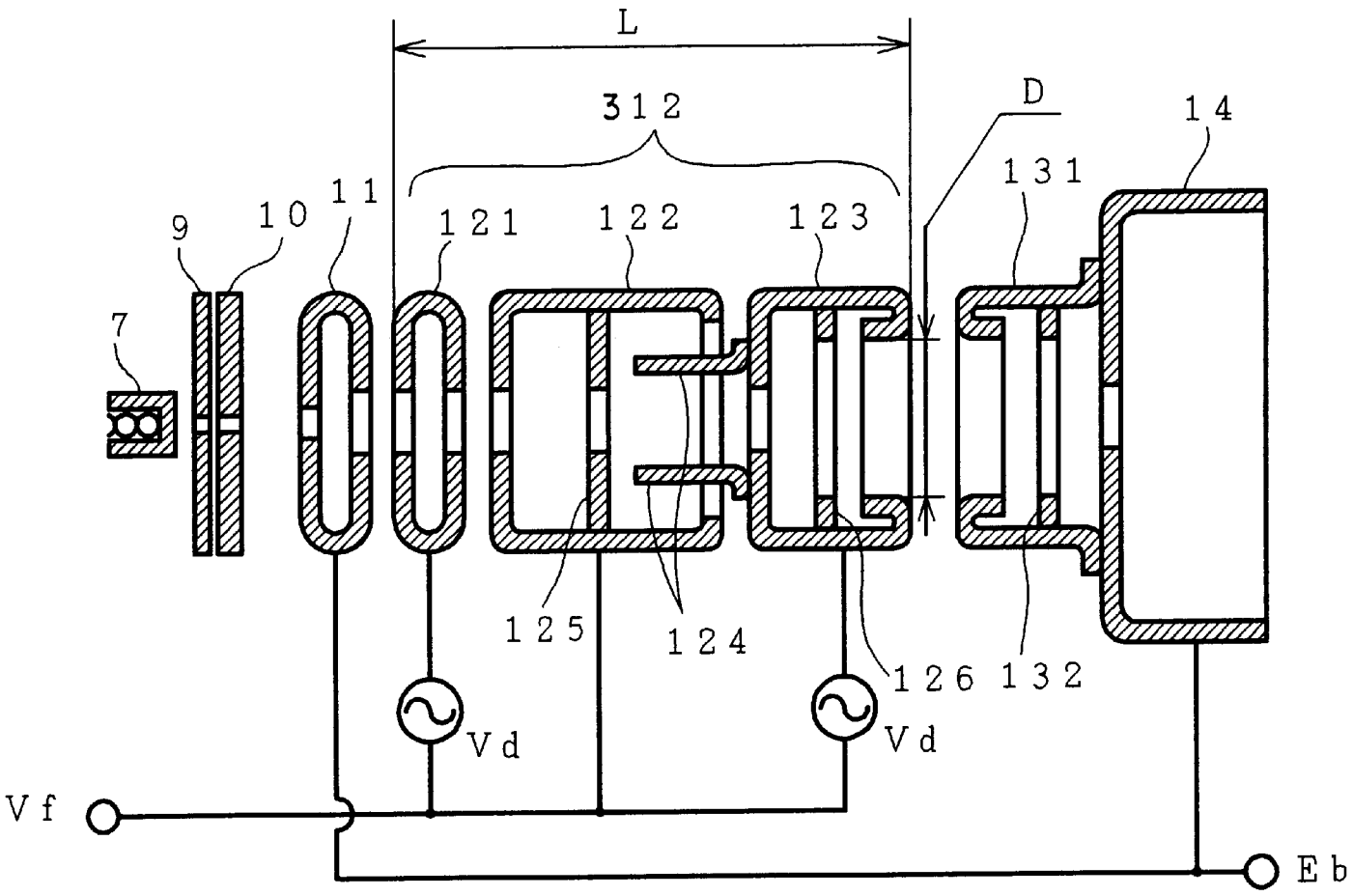
FIG. 6 is an axial section view of the electron gun of the second embodiment of the present invention.

FIG. 6 is an illustration of the second embodiment of the present invention in which the quadrupole lens is formed at one location only.

In the figure, a basic difference from the embodiment explained in FIG. 4 is that a quadrupole lens is formed only between the second member 122 and the third member 123 constituting the focussing electrode 212. The other constitution is the same as that in FIG. 4.

In this constitution, by extending the flat correction electrodes 124 constituting the quadrupole lens toward the first member 122 or by narrowing the spacing between a pair of opposing upper and lower correction electrodes 124, the strength of the quadrupole lens can be increased, so that dynamic corrections of both astigmatic aberration and curvature-of-field aberration can be executed at the same time in the same way as with the constitution explained in FIG. 4.

The quadrupole lens can be positioned between the first member 121 and the second member 122.

A constitution in which three or more quadrupole lenses are installed can be realized.

Figure 7:
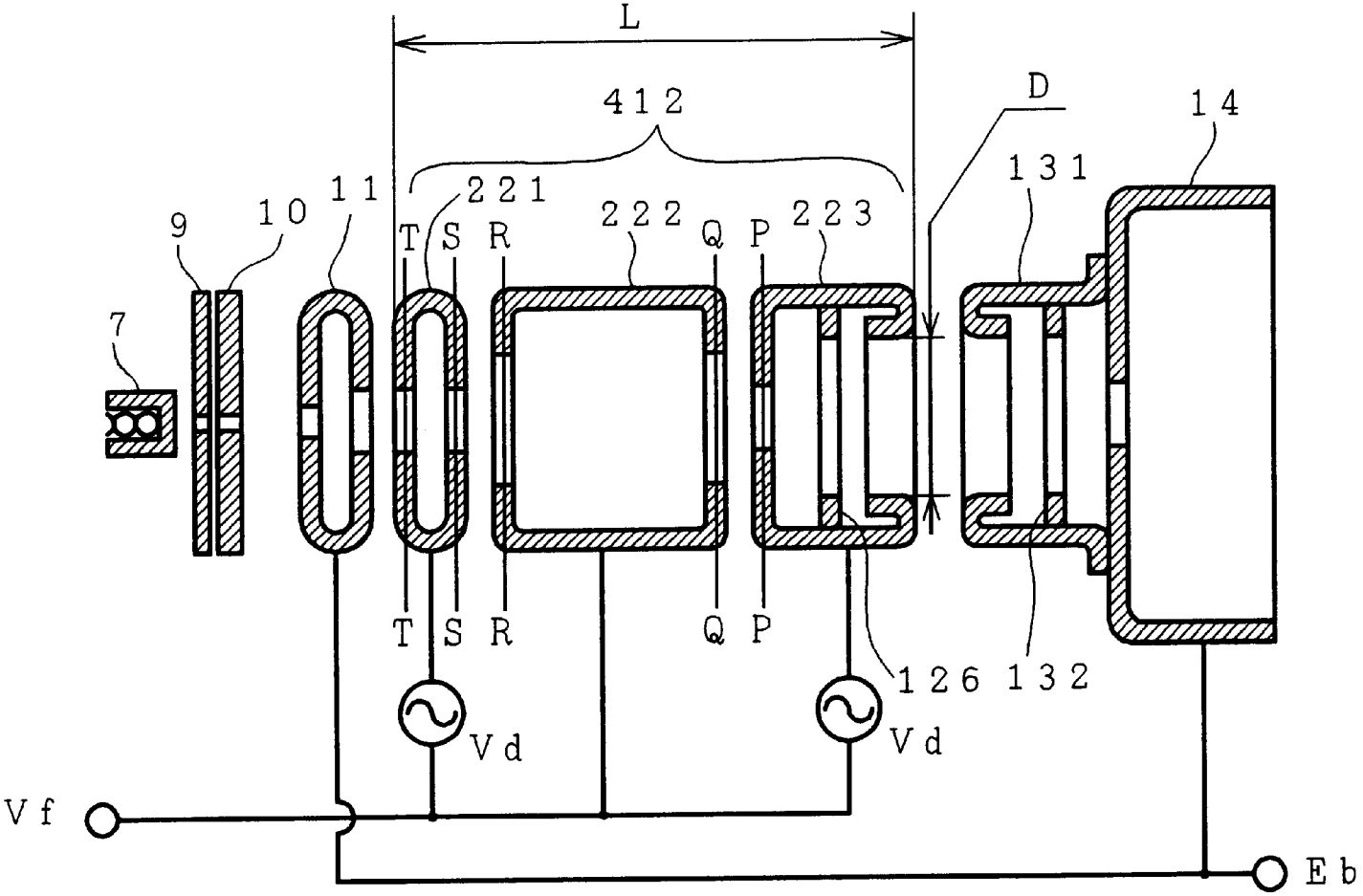
FIG. 7 is an axial section view of the electron gun of the third embodiment of the present invention.
Figure 8:
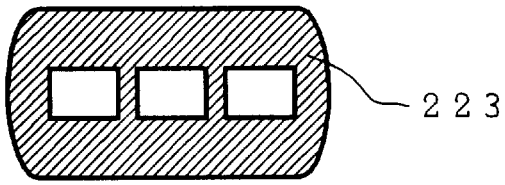
FIG. 8(*a*) to FIG. 8(*e*) are section views of lines P—P, Q—Q, R—R, S—S, and T—T of the essential sections of the electrode forming the rotationally asymmetrical electron lens shown in FIG. 7, respectively.
Figure 8:
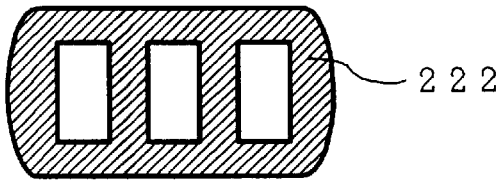
Figure 8:
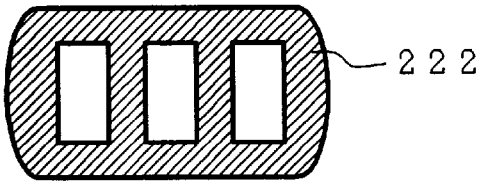
Figure 8:
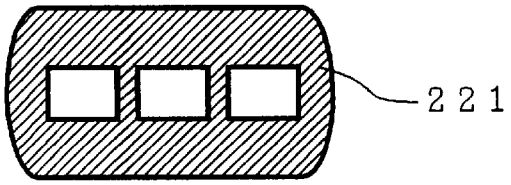
Figure 8:
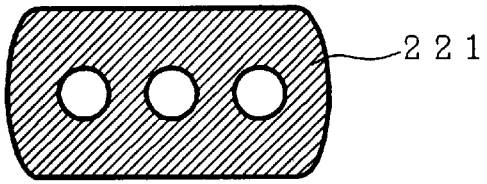

FIG. 7 shows the third embodiment of the present invention. FIG. 8(*a*) to FIG. 8(*e*) are section views of lines P—P, Q—Q, R—R, S—S, and T—T of the essential sections of the electrodes forming the rotationally asymmetrical electron lens shown in FIG. 7, respectively. The focussing electrode 12 is divided into three parts such as a first member 221, a second member 222, and a third member 223, and to form a rotationally asymmetrical electron lens, the electron beam passing apertures made in the end faces of the first member 221 and third member 223 which are opposite to the second member 222 are horizontally elongated as shown in FIG. 8(*a*) and FIG. 8(*d*) and the electron beam passing apertures made in the end faces of the second member 222 which are opposite to the first member 221 and third member 223, respectively, are vertically elongated as shown in FIG. 8(*b*) to FIG. 8(*c*), and a dynamic focus voltage is applied to the first member 221 and third member 223. Rotationally asymmetrical electron lenses are formed between the first and second members 221, 222 and between the second and third members 222, 223 and the astigmatic aberration is corrected by the quadrupole lens effect thereof. In this case, as the amount of deflection increases, the potential differences between the first accelerating electrode 412 and the first member 221 and between the third member 223 and the second accelerating electrode 131 are reduced and the curvature-of-field aberration is corrected at two locations. Namely, the same effects as in the embodiment shown in FIG. 4 can be obtained.

FIG. 9 shows the fourth embodiment of the present invention including a focusing electrode 512. FIG. 10(*a*) to FIG. 10(*d*) are section views of lines U—U, V—V, W—W, and X—X shown in FIG. 9, respectively. In the figure, basic differences from the embodiment explained in FIG. 4 are that the shapes of the electron beam passing apertures in the opposite ends of the electrode members 131 and 123 constituting the main lens are cylinders corresponding to each electron beam and the electrode plates 132 and 126 are not installed. The other constitution is the same as that in FIG. 4. Therefore, the same effects as in the embodiment shown in FIG. 4 can be obtained.

According to the present invention, the resolution in the peripheral area of the screen can be improved with a comparatively low dynamic focus voltage. Namely, an increase in the cost of circuit due to installation of a high dynamic focus voltage generating circuit can be suppressed. Or, degradation of the resolution in the peripheral area of the screen due to an insufficient magnitude of the dynamic focus voltage can be suppressed.

What is claimed is:

1. A color picture tube having an electron gun comprising:

first electrode means for generating three electron beams and for directing said electron beams to a phosphor screen along initial paths which are substantially parallel to each other on one horizontal plane; and second electrode means constituting a main lens for focusing said electron beams to said phosphor screen, wherein said electron gun is structured so that said main lens comprises:

a first accelerating electrode, a focussing electrode and a second accelerating electrode toward said phosphor screen in the order named;

a high voltage being applied to said first accelerating electrode and said second accelerating electrode;

a medium voltage being applied to said focusing electrode;

said focusing electrode including a plurality of electrode members;

a length of said focusing electrode is at least two times a diameter of an opening formed in an end of one of said plurality of electrode members facing said second accelerating electrode;

said length of said focusing electrode being measured from an end thereof facing said first accelerating electrode to an end thereof facing said second accelerating electrode;

said diameter of said opening being measured in a direction perpendicular to said one horizontal plane;

a correction electrode for forming a rotationally asymmetrical electron lens being disposed in said focusing electrode;

a voltage which increases with an increasing deflection current to be supplied to a deflection yoke mounted on said color picture tube to scan said electron beams on said phosphor screen being applied to one of said plurality of electrode members facing said first or second accelerating electrode;

a strength of said rotationally asymmetrical electron lens varying in accordance with a deflection angle of said electron beams; and a strength of a lens formed at least one of between said first accelerating electrode and one of said plurality of electrode members facing said first accelerating electrode and between said second accelerating electrode and one of said plurality of electrode members facing said second accelerating electrode weakening with an increase in said deflection angle of said electron beams.

2. A color picture tube according to claim 1 wherein said focussing electrode comprises at least a first electrode member, a second electrode member and a third electrode member toward said phosphor screen in the order named; and said correction electrode for forming a rotationally asymmetrical electron lens is disposed in at least one of a space between said third electrode member and said second electrode member and a space between said first electrode member and said second electrode member.

3. A color picture tube according to claim 2, wherein said correction electrode for forming a rotationally asymmetrical electron lens is disposed in a space between said third electrode member and said second electrode member.

4. A color picture tube according to claim 2, wherein said correction electrode for forming a rotationally asymmetrical electron lens includes a correction electrode member disposed in both of said space between said third electrode member and said second electrode member and said space between said first electrode member and said second electrode member.

5. A color picture tube according to claim 2, wherein:

said correction electrode comprises at least one pair of flat electrodes electrically connected to an end face of at least one of said third electrode member and first electrode member facing said second electrode member; and said at least one pair of flat electrodes extend into an interior of said second electrode member through at least one opening formed in an end face of said second electrode member facing said at least one pair of flat electrodes, said at least one pair of flat electrodes forming said rotationally asymmetrical electron lens.

6. A color picture tube according to claim 5, wherein said at least one pair of flat electrodes are disposed above and below an electron beam passing aperture formed in an end face of at least one of said third electrode member and said first electrode member which are opposite to said second electrode member.

7. A color picture tube according to claim 2, wherein:

at least one of said first electrode member and said third electrode member is formed with an individual horizontally elongated electron beam passing aperture for each of said three electron beams in an end face opposing said second electrode member;

said second electrode member is formed with an individual vertically elongated aperture corresponding to each of said individual horizontally elongated aperture in an end face thereof opposing said at least one of said first member and said third member; and said individual horizontally elongated aperture and said individual vertically elongated aperture forming said rotationally asymmetrical electron lens.

8. A color picture tube according to claim 1, wherein:

a single horizontally elongated opening is formed in each of opposing end faces of said second accelerating electrode and one of said plurality of electrode members facing said second accelerating electrode; and a plate electrode having an individual opening for each of said three electron beams is disposed in each of said second accelerating electrode and one of said plurality of electrode members facing said second accelerating electrode.

9. A color picture tube having an electron gun comprising:

first electrode means for generating three electron beams and for directing said electron beams to a phosphor screen along initial paths which are substantially parallel to each other on one horizontal plane; and second electrode means constituting a main lens for focusing said electron beams to said phosphor screen;

wherein said electron gun is structured so that said main lens comprises:

a first accelerating electrode, a focussing electrode and a second accelerating electrode toward said phosphor screen in the order named;

a high voltage being applied to said first accelerating electrode and said second accelerating electrode;

a medium voltage being applied to said focussing electrode;

said focussing electrode including a plurality of electrode members;

a length of said focussing electrode is at least two times a diameter of an opening formed in an end of one of said plurality of electrode members facing said second accelerating electrode;

said length of said focussing electrode being measured from an end thereof facing said first accelerating electrode to an end thereof facing said second accelerating electrode;

said diameter of said opening being measured in a direction perpendicular to said one horizontal plane;

a correction electrode for forming a rotationally asymmetrical electron lens being disposed in said focussing electrode;

a voltage which increases with an increasing deflection current to be supplied to a deflection yoke mounted on said color picture tube to scan said electron beams on said phosphor screen being applied to at least one of said plurality of electrode members facing said first and second accelerating electrodes;

a strength of said rotationally asymmetrical electron lens varying in accordance with a deflection angle of said electron beams; and a strength of lenses formed at least one of between said first accelerating electrode and one of said plurality of electrode members facing said first accelerating electrode and between said second accelerating electrode and one of said plurality of electrode members facing said second accelerating electrode weakening with an increase in said deflection angle of said electron beams.

10. A color picture tube according to claim 9, wherein:

said focussing electrode comprises at least a first electrode member, a second electrode member and a third electrode member toward said phosphor screen in the order named; and said correction electrode for forming a rotationally asymmetrical electron lens is disposed in at least one of a space between said third electrode member and said second electrode member and a space between said first electrode member and said second electrode member.

11. A color picture tube according to claim 10, wherein said correction electrode comprises at least one pair of flat electrodes electrically connected to an end face of at least one of said third electrode member and first electrode member facing said second electrode member; and said at least one pair of flat electrodes extend into an interior of said second electrode member through at least one opening formed in an end face of said second electrode member facing said at least one pair of flat electrodes, said at least one pair of flat electrodes forming said rotationally asymmetrical electron lens.

12. A color picture tube according to claim 11, wherein said at least one pair of flat electrodes are disposed above and below an electron beam passing aperture formed in an end face of at least one of said third electrode member and said first electrode member which are opposite to said second electrode member.

13. A color picture tube according to claim 10, wherein:

at least one of said first electrode member and said third electrode member is formed with an individual horizontally elongated electron beam passing aperture for each of said three electron beams in an end face opposing said second electrode member;

said second electrode member is formed with an individual vertically elongated aperture corresponding to each of said individual horizontally elongated aperture in an end face thereof opposing said at least one of said first member and said third member; and said individual horizontally elongated aperture and said individual vertically elongated aperture forming said rotationally asymmetrical electron lens.

14. A color picture tube according to claim 9, wherein said correction electrode for forming a rotationally asymmetrical electron lens is disposed in a space between said third electrode member and said second electrode member.

15. A color picture tube according to claim 14, wherein said correction electrode for forming a rotationally asymmetrical electron lens includes a correction electrode member disposed in both of said space between said third electrode member and said second electrode member and said space between said first electrode member and said second electrode member.

16. A color picture tube according to claim 9, wherein:

a single horizontally elongated opening is formed in each of opposing end faces of said second accelerating electrode and one of said plurality of electrode members facing said second accelerating electrode; and a plate electrode having an individual opening for each of said three electron beams is disposed in each of said second accelerating electrode and one of said plurality of electrode members facing said second accelerating electrode.

17. A color picture tube according to claim 9, wherein said voltage which increases with an increasing deflection current is applied to respective ones of said plurality of electrode members facing said first and second accelerating electrodes, and the strength of said lenses formed both between said first accelerating electrode and said one of said plurality of electrode members facing said first accelerating electrode and between said second accelerating electrode and said one of said plurality of electrode members facing said second accelerating electrode weaken with said increase in said deflection angle of said electron beams.

18. A color picture tube having an electron gun comprising:

first electrode means for generating three electron beams and for directing said three electron beams to a phosphor screen along initial paths which are substantially parallel to each other on one horizontal plane; and second electrode means constituting a main lens for focussing said electron beams to said phosphor screen;

wherein said electron gun is structured so that said main lens comprises;

a first accelerating electrode, a focussing electrode, and a second accelerating electrode toward said phosphor screen in the order named;

a high voltage being applied to said first accelerating electrode and said second accelerating electrode;

a medium voltage being applied to said focussing electrode;

said focussing electrode includes a plurality of electrode members;

a length of said first accelerating electrode being between 10% and 200% of a diameter of an electron beam passing aperture formed in said first accelerating electrode on a side thereof facing said focussing electrode;

a correction electrode for forming a rotationally asymmetrical electron lens being disposed in said focussing electrode;

a voltage which increases with an increasing deflection current to be supplied to a deflection yoke mounted on said color picture tube to scan said electron beams on said phosphor screen being applied to one of said plurality of electrode members facing one of said first and second accelerating electrode;

a strength of said rotationally asymmetrical electron lens varying in accordance with a deflection angle of said electron beams; and a strength of a lens formed at least one of between said first accelerating electrode and one of said plurality of electrode members facing said first accelerating electrode and between said second accelerating electrode and one of said plurality of electrode members facing said second accelerating electrode weakening with an increase in said deflection angle of said electron beams.

19. A color picture tube according to claim 18, wherein a length of said focussing electrode is at least two times a diameter of an opening formed in an end of one of said plurality of electrode members facing said second accelerating electrode; and said length of said focussing electrode being measured from an end thereof facing said first accelerating electrode to an end thereof facing said second accelerating electrode, and said diameter of said opening being measured in a direction perpendicular to said one horizontal plane.

* * * * *